US008956107B2

(12) United States Patent
Ohishi

(10) Patent No.: US 8,956,107 B2
(45) Date of Patent: Feb. 17, 2015

(54) AIR CONDITIONER

(75) Inventor: Yasuhiro Ohishi, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 624 days.

(21) Appl. No.: 13/126,550

(22) PCT Filed: Oct. 8, 2009

(86) PCT No.: PCT/JP2009/067547

§ 371 (c)(1),
(2), (4) Date: Apr. 28, 2011

(87) PCT Pub. No.: WO2010/050349

PCT Pub. Date: May 6, 2010

(65) Prior Publication Data

US 2011/0211944 A1 Sep. 1, 2011

(30) Foreign Application Priority Data

Oct. 29, 2008 (JP) ..... 2008-278097

(51) Int. Cl.
*F24F 13/08* (2006.01)
*F24F 1/00* (2011.01)
*F24F 13/20* (2006.01)

(52) U.S. Cl.
CPC ..... *F24F 13/082* (2013.01); *F24F 1/0011* (2013.01); *F24F 2001/0048* (2013.01); *F24F 2013/205* (2013.01)
USPC ..... 415/121.2

(58) Field of Classification Search
CPC ..... F24F 1/0011; F24F 13/082; F24F 13/084; F24F 2001/0048; F24F 2013/082; F24F 2013/205; F24F 2221/32; F04D 29/703
USPC ..... 415/121.2, 53.1, 53.2, 53.3; 416/247 R
See application file for complete search history.

(56) References Cited

U.S. PATENT DOCUMENTS 3,219,261 A * 11/1965 Laing ..... 415/53.1
5,658,197 A 8/1997 Kil
2008/0318512 A1* 12/2008 Kern ..... 454/317

FOREIGN PATENT DOCUMENTS

DE 9205951 U1 10/1993
DE 202005012570 U1 11/2005
EP 1016833 A2 7/2000

(Continued)

*Primary Examiner* — Ned Landrum
*Assistant Examiner* — Brian O Peters
(74) *Attorney, Agent, or Firm* — Birch, Stewart, Kolasch & Birch, LLP

(57) ABSTRACT

There is provided an air conditioner having a fan guard assembly which is easy to assemble, and the transversal crosspieces of the fan guard assembly are not easily disengaged from the longitudinal crosspieces. The air conditioner includes: an air conditioner, comprising: a housing accommodating therein an air delivery fan and having a discharge opening from which an airflow generated by the air delivery fan is blown out; and a fan guard assembly disposed between the air delivery fan and the discharge opening, in the housing, wherein the fan guard assembly includes a first member having a protruding portion protruding in such a manner as to form a retaining groove, and a second member held in the retaining groove of the first member; and the protruding portion protrudes in such a manner that, in a side view, the protruding portion intersects a rectilinear line passing a center point of the second member held by the retaining groove and an arbitrary point P1 along an edge of the discharge opening.

10 Claims, 14 Drawing Sheets

(56) References Cited

FOREIGN PATENT DOCUMENTS

| | | | | | |
|---|---|---|---|---|---|
| GB | 2281094 | A | * | 2/1995 | |
| JP | 8-226698 | A | | 9/1996 | |
| JP | 11-37537 | A | | 2/1999 | |
| JP | 11-83070 | | * | 3/1999 | ..... F24F 1/00 |
| JP | 2005-188871 | A | | 7/2005 | |
| JP | 2006-10257 | A | | 1/2006 | |
| JP | 4285586 | | * | 4/2009 | ..... F24F 13/20 |

* cited by examiner

AIR CONDITIONER

TECHNICAL FIELD

The present invention relates to an air conditioner having a fan guard assembly disposed between an air delivery fan and a discharge opening.

BACKGROUND ART

Traditional indoor units include the one including a housing accommodating therein an air delivery fan and having a discharge opening for blowing out an airflow generated by the air delivery fan; and a fan guard assembly disposed between the air delivery fan and the discharge opening in the housing. The fan guard assembly is to prevent a hand or the like from being inadvertently inserted towards the air delivery fan. Such a fun guard assembly is structured in general by a plurality of longitudinal crosspieces extending in a longitudinal direction, which are aligned parallel to one another, and transversal crosspieces aligned parallel to one another, in a direction substantially perpendicular to an alignment direction of the longitudinal crosspieces.

For example, the traditional fan guard assembly may be a hole penetration type in which the transversal crosspieces penetrate through holes formed on the longitudinal crosspieces, or an insertion type (see Patent Document 1, for example) in which the longitudinal crosspieces are provided with recesses for holding the transversal crosspieces and the transversal crosspieces are inserted into these recesses.

PRIOR ART DOCUMENT

Patent Document

[Patent Document 1] Japanese Unexamined Patent Publication No. 226698/1996 (Tokukaihei 8-226698)

DISCLOSURE OF THE INVENTION

Technical Problem

The traditional hole penetration type may cause more troublesome assembly work, and there is a possibility that some of the transversal crosspieces may not be able to assembled with the longitudinal crosspieces due to variation in the external diameter of the transversal crosspieces. Traditional insertion type on the other hand has a problem that the transversal crosspieces are easily disengaged from the longitudinal crosspieces.

An object of the present invention is to provide an air conditioner having a fan guard assembly which is easy to assemble, and the transversal crosspieces are not easily disengaged from the longitudinal crosspieces.

Technical Solution

A first aspect of the present invention is an air conditioner, including: a housing accommodating therein an air delivery fan and having a discharge opening from which an airflow generated by the air delivery fan is blown out; and a fan guard assembly disposed between the air delivery fan and the discharge opening, in the housing, wherein the fan guard assembly includes a first member having a protruding portion protruding in such a manner as to form a retaining groove, and a second member held in the retaining groove of the first member; and the protruding portion protrudes in such a manner that, in a side view, the protruding portion intersects a rectilinear line passing a center point of the second member held by the retaining groove and an arbitrary point along an edge of the discharge opening.

With the air conditioner, the second member does not have to be penetrated through the first member as is required in the traditional hole penetration type, in the process of assembling the fan guard assembly. Further, with the protruding portion provided to the first member, the second member held by the first member is restricted from moving along any rectilinear line extending from the center point to any point along the edge of the discharge opening. In other words, even when a hand or the like inserted from the outside contacts the second member and pushes or pulls the second member, the second member is kept from moving in a direction towards the discharge opening or towards the air delivery fan. Thus, unlike the traditional insertion type, the second member is reliably kept from being disengaged from the first member.

A second aspect of the present invention is an air conditioner which is the air conditioner of the first aspect adapted so that: the protruding portion protrudes towards the discharge opening so as to form the retaining grooves opened towards a side of the discharge opening.

In the air conditioner, a portion of the first member is thickened to reliably preventing the second member from being disengaged from the first member when a hand or the like inserted from outside pulls the second member towards the discharge opening.

A third aspect of the present invention is an air conditioner which is the air conditioner of the first or second aspect, adapted so that: the first member has a plurality of the protruding portions and a plurality of the retaining grooves, and the retaining grooves holds a plurality of the second members, respectively; and the second members are disposed over the entire discharge opening.

In the air conditioner, with the provision of the second members over the entire discharge opening, it is possible to reliably keep the second members from being disengaged from the first member, when a hand or the like inserted from the outside into the housing pushes or pulls the second members. Note that, the expression "over the entire discharge opening" encompasses provision of the plurality of second members over the entire discharge opening along the length of the discharge opening (i.e., in the alignment direction of the first members), and provision of the plurality of second members over the entire discharge opening along a direction perpendicular to the length of the discharge opening (i.e., in the alignment direction of the second members).

A fourth aspect of the present invention is an air conditioner which is the air conditioner of any one of the first to third aspects, adapted so that the or each protruding portion has a leading end which is formed in a substantially triangular shape.

In the air conditioner, the leading end of the or each protruding portion is formed in a substantially triangular shape. This prevents the wind being disturbed by air vortices generated nearby the leading end of the protruding portion. Thus, condensation on the fan guard assembly is more effectively restrained than the traditional air conditioners.

A fifth aspect of the present invention is an air conditioner which is the air conditioner of any one of the first to third aspects, adapted so that the or each protruding portion has a sub-protrusion for fixing the second member held in the retaining groove in that retaining groove.

With the air conditioner having the protruding portion having the sub-protrusion, the second member is kept from being disengaged from the first member, once assembled with the first member.

Advantageous Effects

As described hereinabove, the present invention brings about the following effects.

With the first aspect, the second member does not have to be penetrated through the first member as is required in the traditional hole penetration type, in the process of assembling the fan guard assembly. Further, with the protruding portion provided to the first member, the second member held by the first member is restricted from moving along any rectilinear line extending from the center point to any point along the edge of the discharge opening. In other words, even when a hand or the like inserted from the outside contacts the second member and pushes or pulls the second member, the second member is kept from moving in a direction towards the discharge opening or towards the air delivery fan. Thus, unlike the traditional insertion type, the second member is reliably kept from being disengaged from the first member.

In the second aspect, a portion of the first member is thickened to reliably preventing the second member from being disengaged from the first member when a hand or the like inserted from outside pulls the second member towards the discharge opening.

Further, with the provision of the second members over the entire discharge opening in the third aspect, it is possible to reliably prevent the second pieces from being disengaged from the first members, when a hand or the like inserted from the outside into the housing pushes or pulls the second members. Note that, the expression "over the entire discharge opening" encompasses provision of the plurality of second members over the entire discharge opening along the length of the discharge opening (i.e., in the alignment direction of the plurality of first members), and provision of the plurality of second members over the entire discharge opening along a direction perpendicular to the length of the discharge opening (i.e., in the alignment direction of the second members).

In the fourth aspect, the leading end of the or each protruding portion is formed in a substantially triangular shape. This prevents the wind being disturbed by air vortices generated nearby the leading end of the protruding portion. Thus, condensation on the fan guard assembly is more effectively restrained than the traditional air conditioners.

With the fifth aspect of the present invention having the protruding portion having the sub-protrusion, the second member is kept from being disengaged from the first member, once assembled with the first member.

REFERENCE NUMERALS

1 indoor unit (air conditioner)
11. Main body casing (housing)
13. Cross flow fan (air delivery fan)
17*f*. Discharge port (discharge opening)
2*l*, 12*l* fan guard assembly
30 to 33, and 130 Longitudinal crosspiece (first member)
40 to 45, and 140 to 145 Transversal crosspiece (second member)
50 to 55, and 150 to 155 Protruding portion
50*a*, 51*a* sub-protrusion
60 to 65, and 160 to 165 Retaining grooves
$C_{40}$ to $C_{45}$, $C_{140}$ to $C_{145}$ Center points
L1 to L6, and L101 to L106 Rectilinear line
V Edge

BEST MODE FOR CARRYING OUT THE INVENTION

Figure 1:
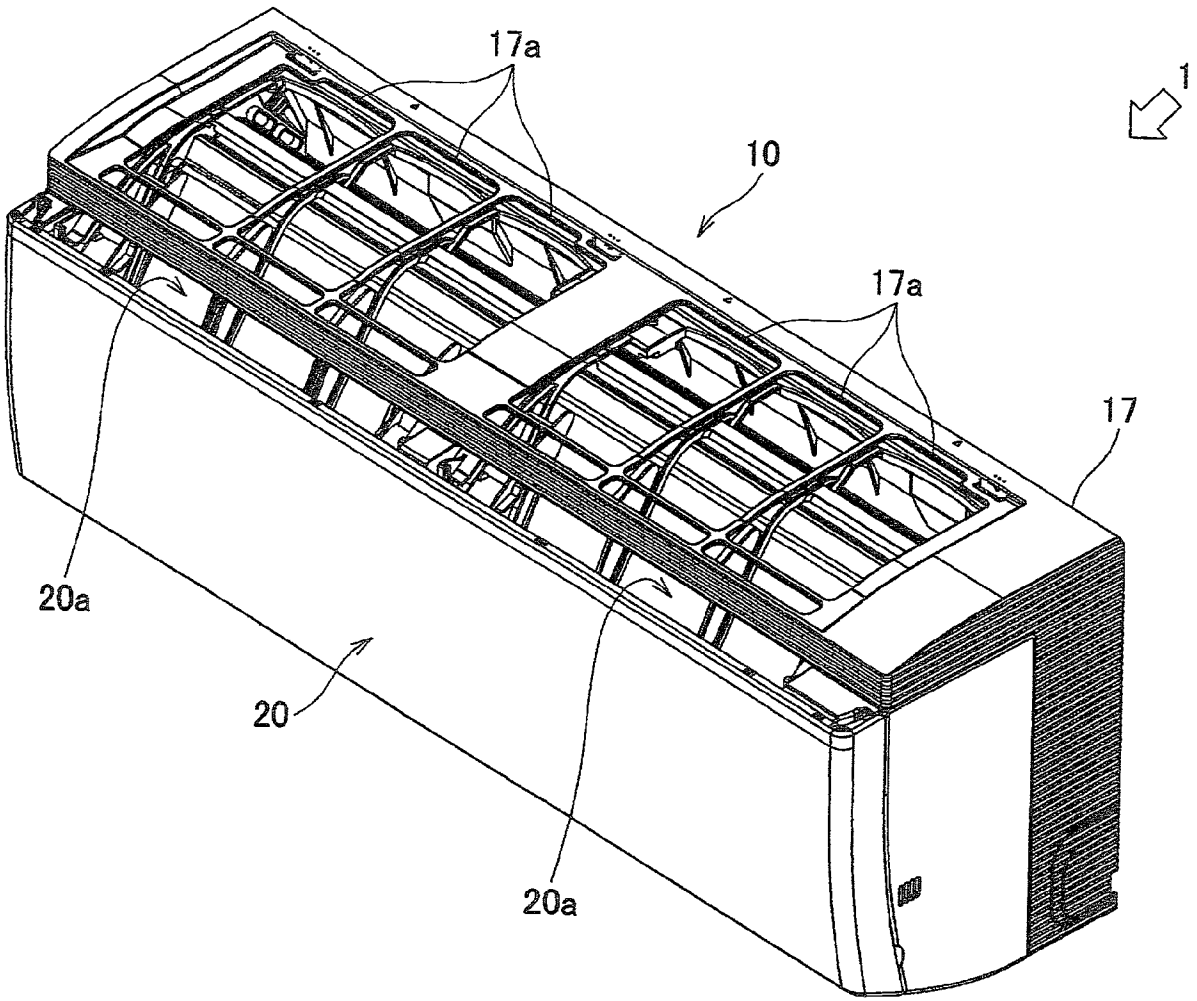
FIG. 1 is a perspective view of an embodiment according to the present invention, and provides an obliquely front view of an air conditioner.
Figure 2:
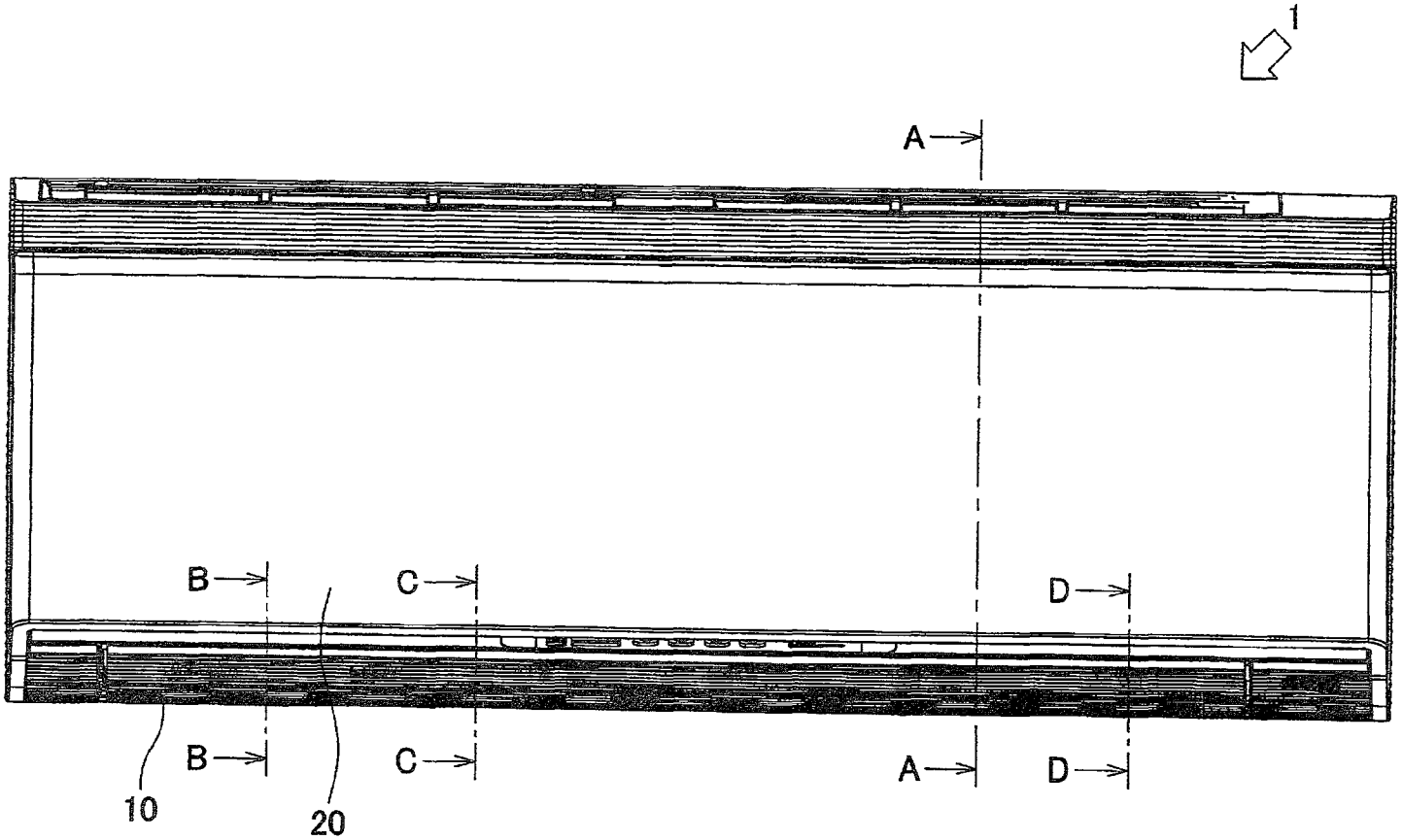
FIG. 2 is a schematic front view of an indoor unit shown in FIG. 1.
Figure 3:
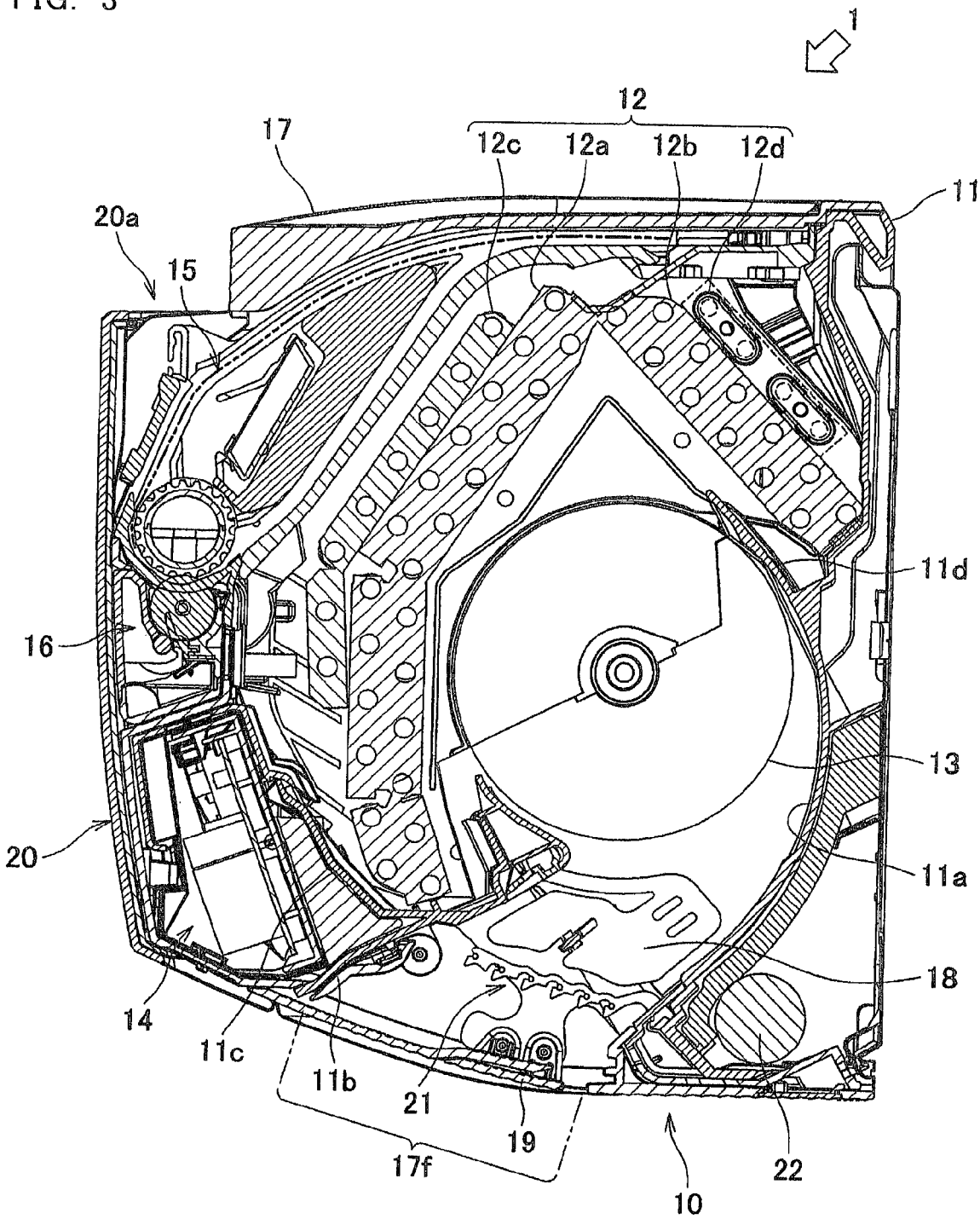
FIG. 3 is a schematic cross sectional view of the indoor unit shown in FIG. 2.
Figure 4:
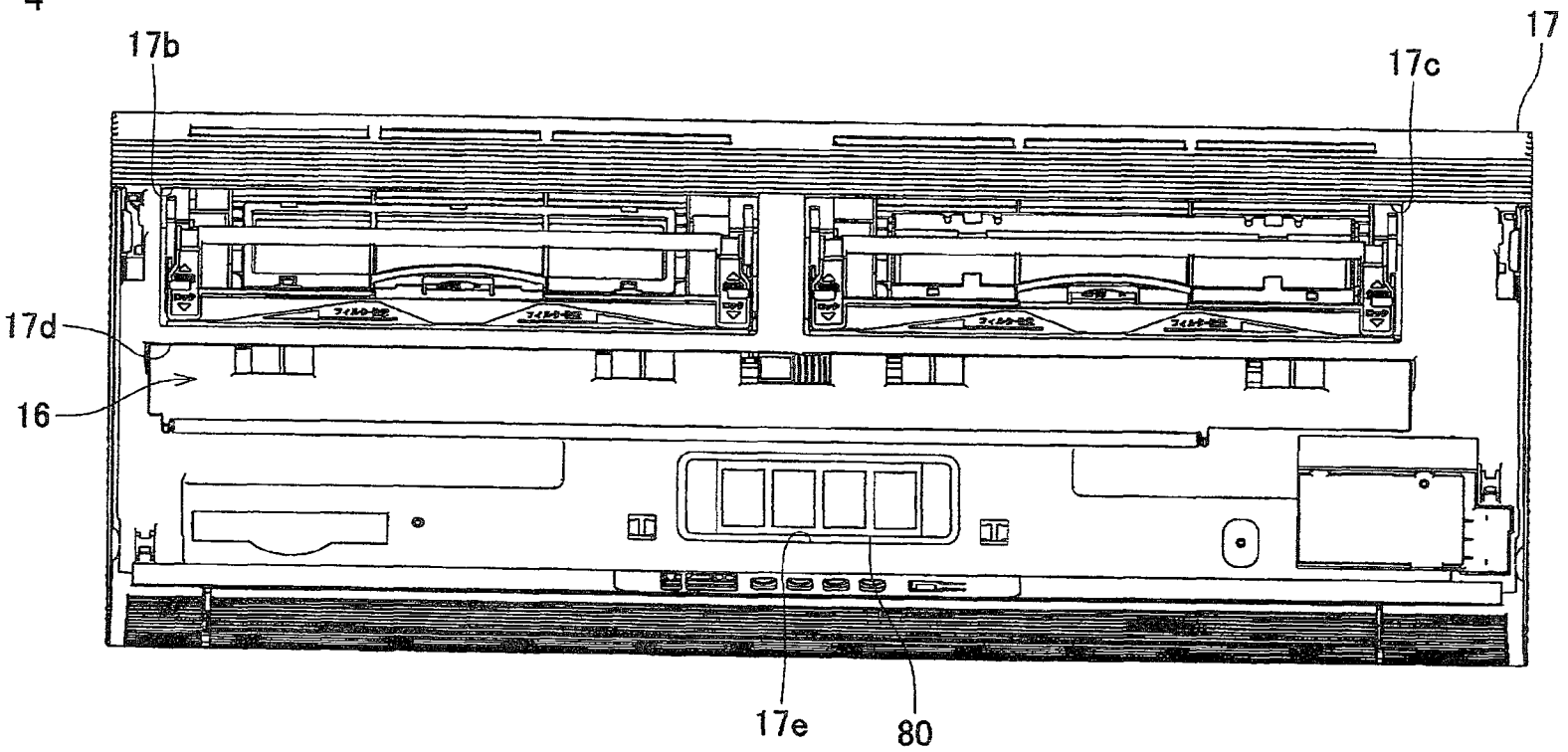
FIG. 4 is a schematic view of the indoor unit shown in FIG. 2 with a front panel being detached.

The following describes, with reference to attached drawings, a structure of an air conditioner of one embodiment, according to the present invention. FIG. 1 is a perspective view of an embodiment of the present invention, and provides an obliquely front view of an indoor unit 1 (air conditioner). FIG. 2 is a schematic front view of the indoor unit 1 shown in FIG. 1. FIG. 3 is a schematic cross sectional view of the indoor unit 1 taken along the line A-A in FIG. 2. FIG. 4 is a schematic view showing the indoor unit 1 shown in FIG. 2 with a front panel being detached.

As shown in FIG. 1, an indoor unit 1 of the present embodiment has an elongated shape which is long in one direction. The indoor unit 1 is connected to an outdoor unit installed outside the room, and is attached to an indoor wall by using a mounting board 70 (see FIG. 11) so that the length thereof is horizontal. This indoor unit 1 has a main unit 10 and a front panel 20 attached to the front side of the main unit 10.

As shown in FIG. 3, the main unit 10 has a main casing 11 (housing), an indoor heat exchanger 12, a cross flow fan 13 (air delivery fan), an electrical component unit 14, a filter unit 15, a cleaning unit 16, and a front grill 17.

The indoor heat exchanger 12, the cross flow fan 13, the electrical component unit 14, and the filter unit 15 are attached to the main casing 11. The front grill 17 is attached to the main casing 11 from the front side so as to cover the members such as an indoor heat exchanger 12. The cleaning unit 16 is fitted in the front side of the front grill 17 from the outside of the front grill 17 so that the cleaning unit 16 is held while abutting against the filter unit 15.

The indoor heat exchanger 12 is a plate-fin heat exchanger having a front heat exchanger 12*a* and a rear heat exchanger 12*b* arranged in a shape of a counter-V, in relation to the main casing 11. Note that, in the indoor unit 1 of the present embodiment, an auxiliary heat exchanger 12*c* is attached on the front side of the front heat exchanger 12*a*. Further, on the rear face of the rear heat exchanger 12*b* is attached an auxiliary heat exchanger 12*d*. The auxiliary heat exchanger 12*c* and the auxiliary heat exchanger 12*d* facilitate heat exchanging between a refrigerant and the air.

The front heat exchanger 12*a*, the rear heat exchanger 12*b*, and the auxiliary heat exchangers 12*c* and 12*d* all have a plurality of refrigerant tubes extended in a horizontal direction. The front heat exchanger 12*a* has refrigerant tubes arranged in two columns and 12 rows, and the rear heat exchanger 12*b* has refrigerant tubes arranged in two columns and 6 rows. Further, the auxiliary heat exchanger 12*c* has refrigerant tubes arranged in one column and 8 rows, and the auxiliary heat exchanger 12*d* has refrigerant tubes arranged in one column and 4 rows.

The front heat exchanger 12*a* includes: an upper part slanted downward and towards the front side; a middle part extending in a vertical direction; and a lower part slanted downwards and towards the rear side. The upper part has the top 6 rows of refrigerant tubes. The middle part has the next 4 rows of refrigerant tubes. The lower part has the rest of next 2 rows of refrigerant tubes. The auxiliary heat exchanger 12*c* has: one part stacked on the upper part of the front heat exchanger 12*a*; and another part stacked on the middle part of the front heat exchanger 12*a*. The one part has the top 6 rows of refrigerant tubes, and the other part has the next two rows of refrigerant tubes.

Most of the air taken in from a later-mentioned ceiling inlet port 17*a* and the front panel 20 sequentially passes the auxiliary heat exchanger 12*c* and the front heat exchanger 12*a*. In other words, the auxiliary heat exchanger 12*c* is disposed at the windward side of the main heat exchanger 12*a*, relative to the flow of the air taken in from the ceiling inlet port 17*a* and the front panel 20. The planar dimension of the auxiliary heat exchanger 12*c* is smaller than that of the main heat exchanger 12*a*, and the main heat exchanger 12*a* is partially disposed on the auxiliary heat exchanger 12*c*.

As shown in FIG. 1, the front grill 17 has the ceiling inlet port 17*a* at its ceiling part. The ceiling inlet port 17*a* is formed by the ceiling part of the front grill 17 which is formed in a grid. Further, as shown in FIG. 4, the front grill 17 has at its upper front part of the front side openings 17*b* and 17*c*. Each of these front side openings 17*b* and 17*c* is formed as a single opening.

Further, the front grill 17 has an opening 17*d* which extends in parallel to the length of the indoor unit 1 below the front side openings 17*b* and 17*c*. To this opening 17*d* is fitted a cleaning unit 16. Further, the front grill 17 has an opening 17*e* through which the front side of the light indicator 80 is exposed. The opening 17*e* is provided below the opening 17*d* and in the middle relative to the length of the indoor unit 1. Further, the opening 17*e* is formed in a shape that substantially corresponds to the front side of the light indicator 80, and the light indicator 80 is fitted in the opening 17*e* in a direction from the inside to the outside of the front grill 17.

As shown in FIG. 1, while the front panel 20 is closed, the external air is sucked into the inside of the front grill 17 from the ceiling inlet port 17*a* of the front grill 17 and a front inlet port 20*a* positioned at the top part of the front panel 20.

As shown in FIG. 3, inside the counter V-shape of the indoor heat exchanger 12 is provided a cross flow fan 13. This cross flow fan 13 is a so-called axial fan, and is disposed in such a manner that its axis extends along the length of the indoor unit 1. The main casing 11 has a scroll part 11*a* having a curved surface, which is formed behind the cross flow fan 13. With the scroll part 11*a*, the air is smoothly guided from the cross flow fan 13 to the discharge port 17*f* (discharge opening) opened at the bottom part on the front side of the front grill 17. The fan guard assembly 21 is disposed between the left/right wind louver 18 and the up/down wind louver 19 in the main casing 11.

The main casing 11 has an upper wall surface lib which is on the upper side of the discharge port 17*f*. The upper wall surface 11*b* is integrally formed with a drain pan 11*c* positioned at the lower part of the second part 51. Between the drain pan 11*c* and the front panel 20 is disposed an electrical component unit 14. Further, below a third part 52 is disposed a rear drain pan 11*d*. The main casing 11, the front grill 17, and the front panel 20 are all long in a sideway. Further, the discharge port 17*f* is formed so as to extend along the length (sideway) of the front grill 17.

In the indoor unit 1, the indoor air sucked in from the ceiling inlet port 17*a* on the top surface and the gap at the upper part of the front panel 20 by the cross flow fan 13 passes the indoor heat exchanger 12, and is cooled or heated through heat exchanging taking place between the air and the refrigerant. The air having undergone the heat exchanging is blown out into the room from the discharge port 17*f* at the bottom surface.

Figure 5:
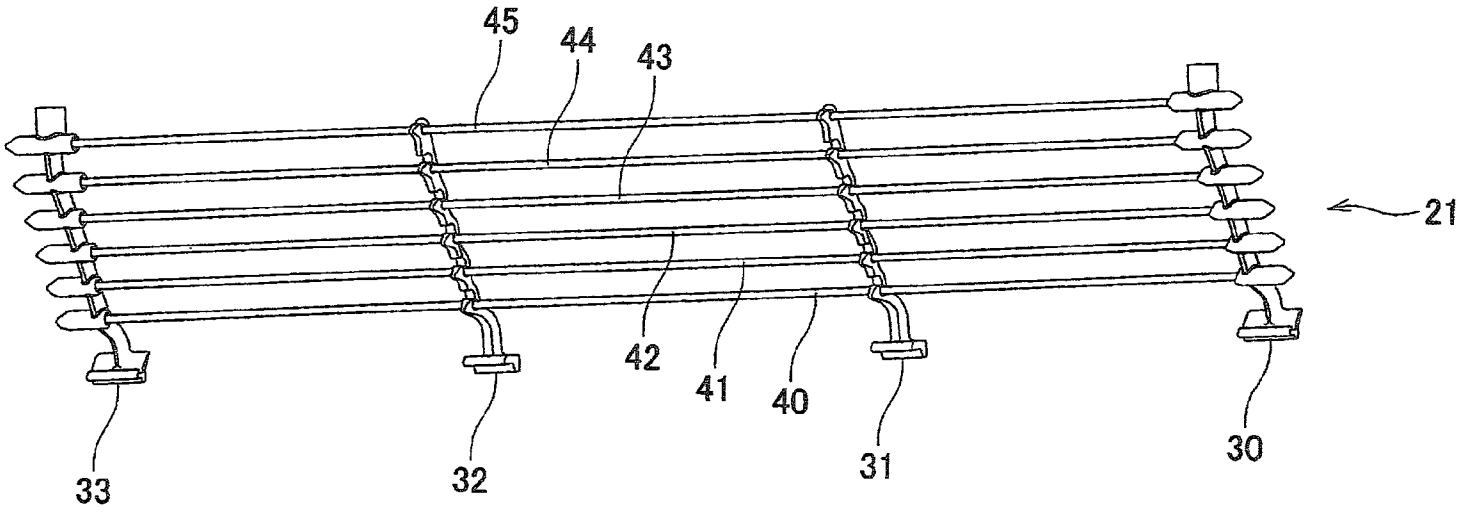
FIG. 5 is a perspective view providing an obliquely front view of a fan guard assembly.

FIG. 5 is a perspective view providing an obliquely front view of the fan guard assembly 21. As shown in the figure, the fan guard assembly 21 has four longitudinal crosspieces 30 to 33 (first members) disposed apart from each other in the length (a direction perpendicular to the sheet surface of FIG. 3) of the discharge port 17*f*, and the six transversal crosspieces 40 to 45 (second members) extending over the entire discharge port 17*f* in the alignment direction of the longitudinal crosspieces 30 to 33. As shown in FIG. 5, the cross pieces 30 to 33 include a pair of outer first members 30 and 33, along with a set of intervening first members 31 and 32 therebetween.

Figure 6:
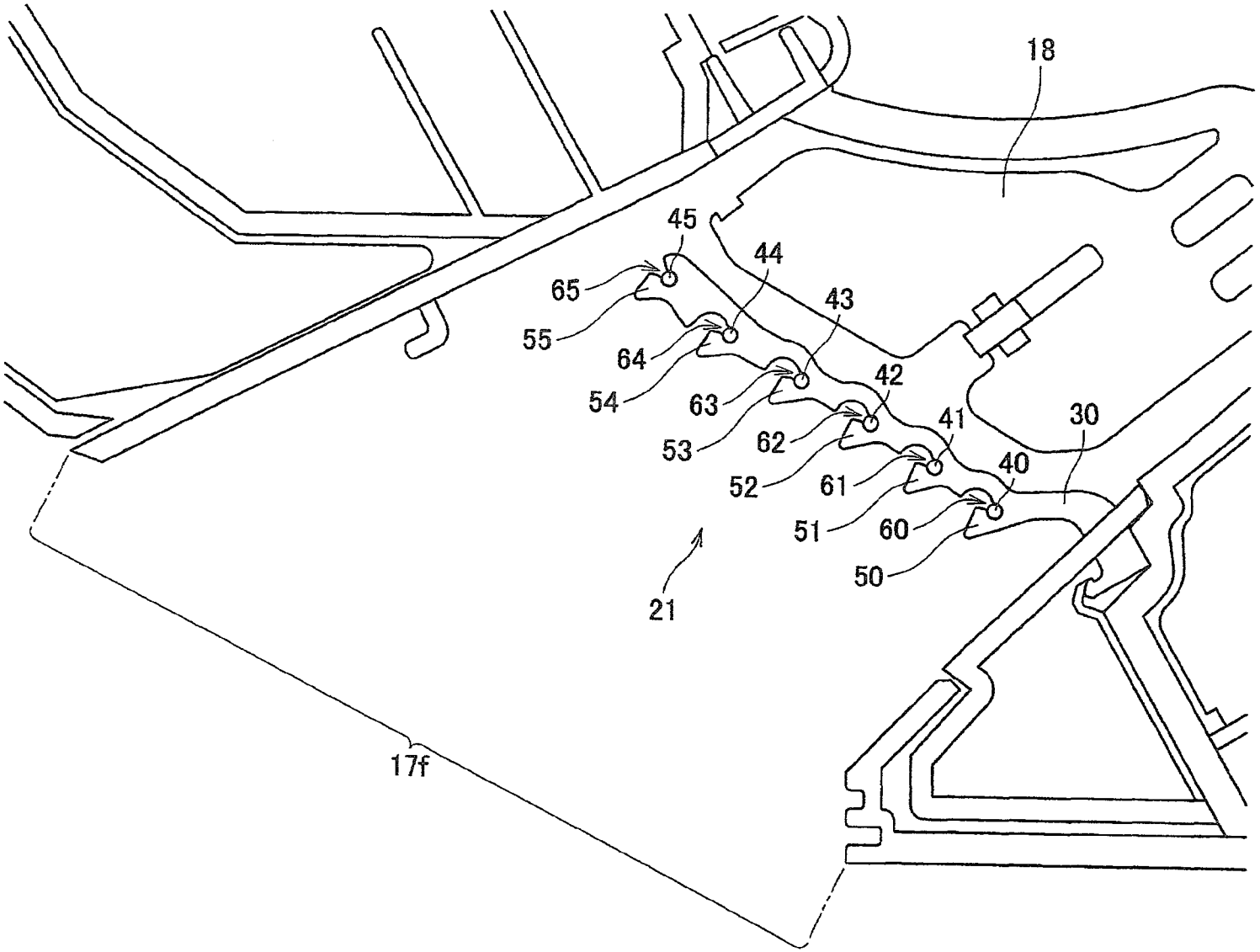
FIG. 6 is a schematic cross sectional view providing an enlarged view of the periphery of the fan guard assembly shown in FIG. 3.

FIG. 6 is a schematic cross sectional view providing an enlarged view of the periphery of the fan guard assembly 21 shown in FIG. 3. As illustrated in the figure, each longitudinal crosspiece 30 has integrally formed therewith protruding portions 50 to 55 which are successively formed from the lower end to the upper end of the discharge port 17*f*. These protruding portions 50 to 55 protrude to form retaining grooves 60 to 65 opened towards the side of the discharge port 17*f*, respectively. The retaining grooves 60 to 65 hold transversal crosspieces 40 to 45, respectively. Although illustration is omitted, each of the longitudinal crosspieces 31 to 33 shown in FIG. 5 has the similar retaining grooves and the protruding portions as is the case of the longitudinal crosspiece 30.

Figure 7:
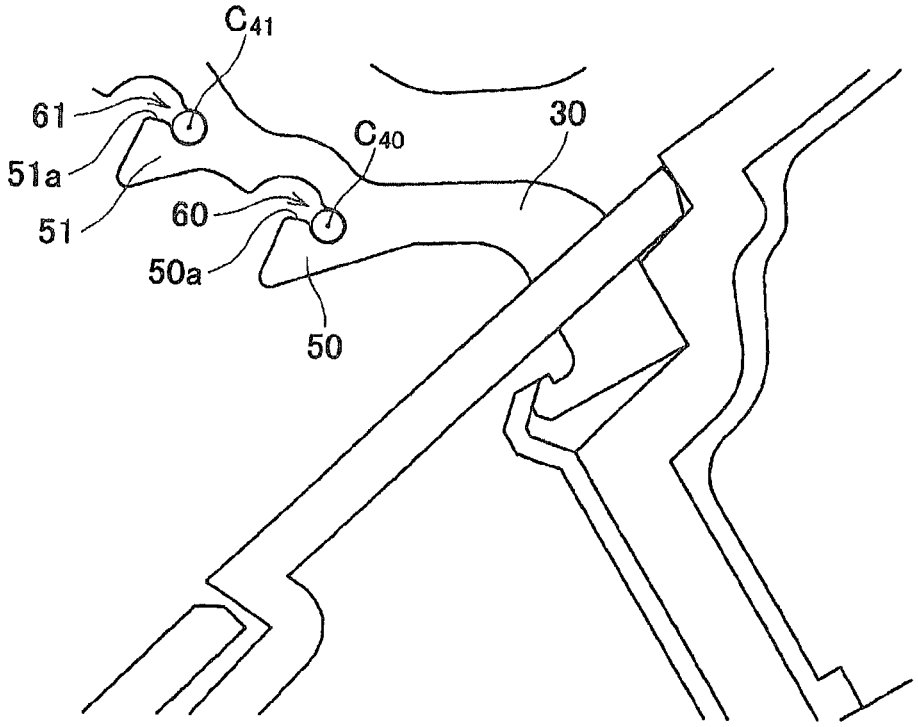
FIG. 7 is a schematic view providing an enlarged view of the periphery of a protruding portion shown in FIG. 6.

FIG. 7 is a schematic view providing an enlarged view of the periphery of the protruding portions 50 and 51 shown in FIG. 6. As shown in the figure, the protruding portions 50 and 51 each has a leading end formed in a substantially triangle shape. Further, the protruding portions 50 and 51 have subprotrusions 50*a* and 51*a* for fixing the transversal crosspieces 40 and 41 in the retaining grooves 60 and 61, respectively. Further, the reference symbols $C_{40}$ and $C_{41}$ respectively indicates the center points of the transversal crosspieces 40 and 41 held in the retaining grooves 60 and 61. Note that the center points of the transversal crosspieces 42 to 45 held in the retaining grooves 62 to 65 shown in FIG. 6 are referred to as center points $C_{42}$ to $C_{45}$, respectively. Note further that, as is the case of the protruding portions 50 and 51, the protruding portions 52 to 55 shown in FIG. 6 also have leading ends formed in a substantially triangle shape, and have sub-protrusions for fixing the transversal crosspieces 42 to 45 in the retaining grooves 62 to 65.

Figure 8:
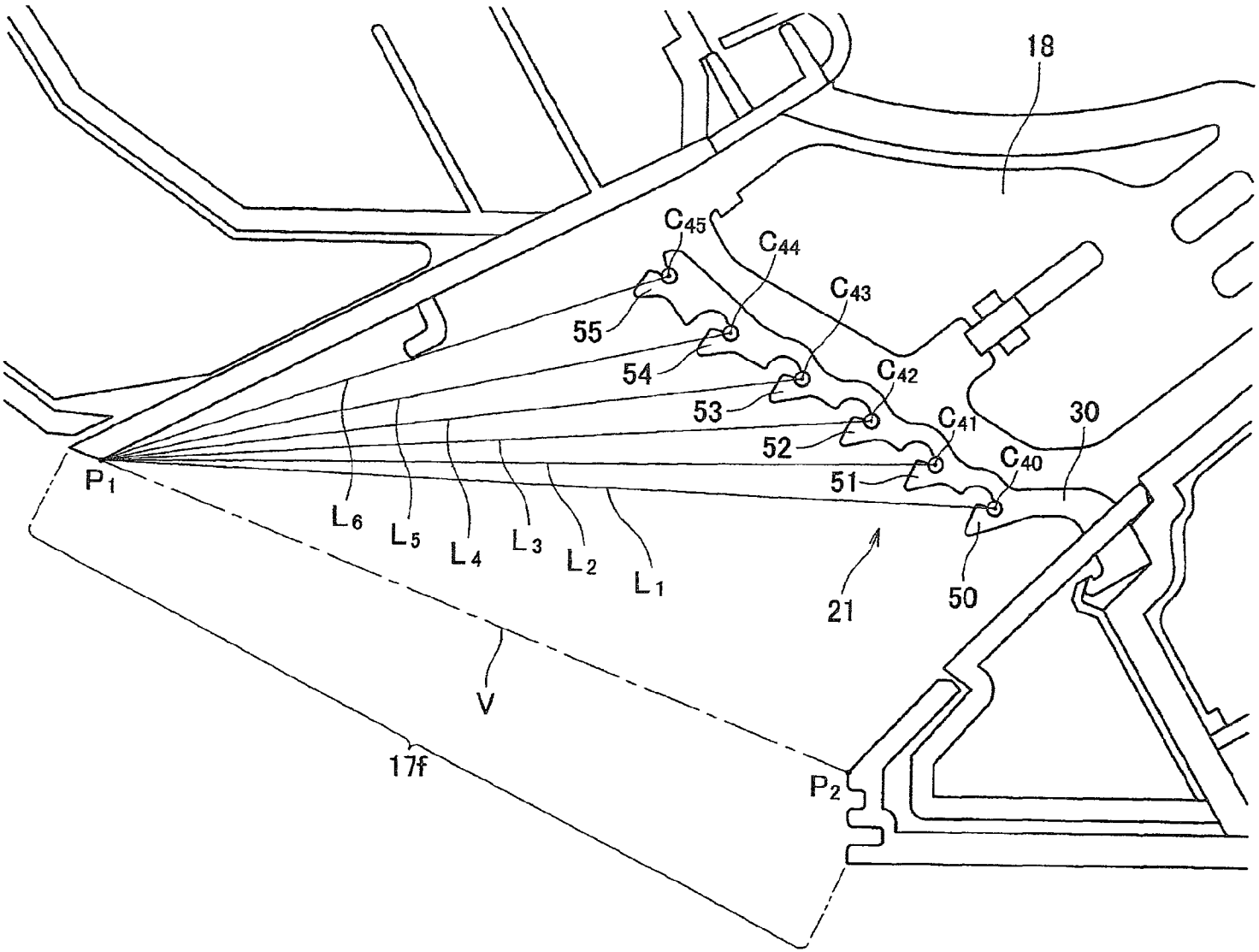
FIG. 8 is a schematic cross sectional view providing an enlarged view of the periphery of the fan guard assembly shown in FIG. 3.

FIG. 8 is a schematic cross sectional view providing an enlarged view of the periphery of the fan guard assembly 21 shown in FIG. 3. The edge V in the figure indicates a part of the main casing 11 from which the air is blown out. For example, the edge V is a rectilinear line (dotted line in the figure) connecting a point P1 at the upper end of the discharge port 17*f* and a point P2 at the lower end of the same in a side view. Further, rectilinear lines L1 to L6 in the figure connect the center points $C_{40}$ to $C_{45}$ with the point P1 on the edge V, respectively. As shown in the figure, each protruding portions 50 to 55 are formed so as to intersect the rectilinear lines L1 to L6, respectively. With the structure, when the transversal crosspieces 40 to 45 are pushed by a hand or the like from the outside, the transversal crosspieces 40 to 45 are restricted from moving in the directions of the rectilinear lines L1 to L6. That is, each of the transversal crosspieces 40 to 45 is kept from being pulled towards the discharge port 17*f*. Thus, unlike the traditional insertion type, the transversal crosspieces 40 to 45 of the present invention are reliably kept from being disengaged from the longitudinal crosspieces 30 to 33, respectively.

Figure 9:
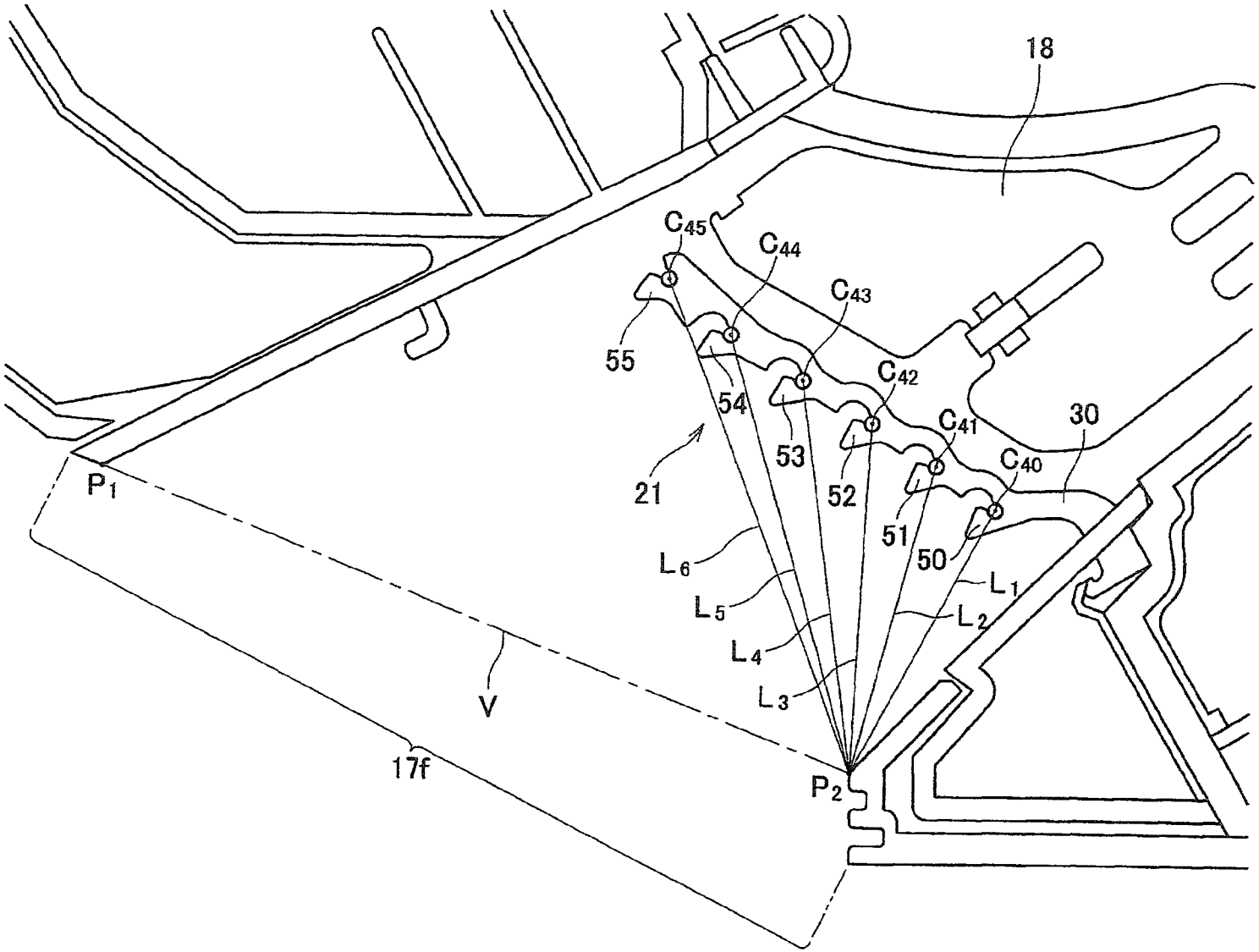
FIG. 9 is a schematic cross sectional view providing an enlarged view of the periphery of the fan guard assembly shown in FIG. 3.

FIG. 9 is a schematic cross sectional view providing an enlarged view of the periphery of the fan guard assembly 21 shown in FIG. 3. The reference symbols L1 to L6 in the figure respectively indicate rectilinear lines connecting the center points $C_{40}$ to $C_{45}$ with the point P2 at the lower end of the discharge port 17*f* along the edge V (dotted line in the figure) of the discharge port 17*f*. As shown in the figure, the protruding portions 50 to 55 are formed so as to intersect the rectilinear lines L1 to L6, respectively, as is the case of FIG. 8. This restricts the movements of the transversal crosspieces 40 to 45 in the directions of the rectilinear lines L1 to L6, and keeps the transversal crosspieces 40 to 45 from moving towards the discharge port 17*f*.

Figure 10:
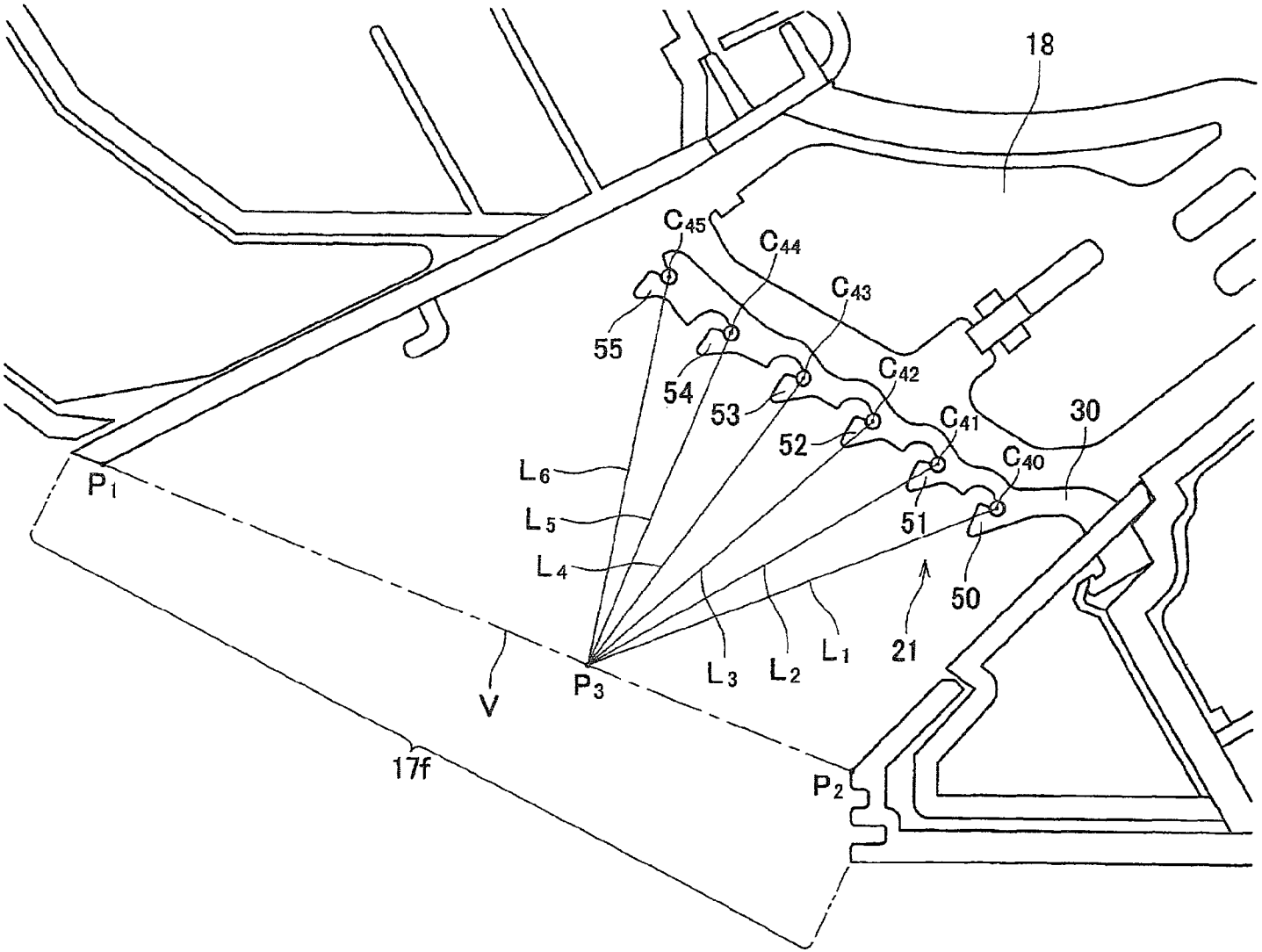
FIG. 10 is a schematic cross sectional view providing an enlarged view of the periphery of the fan guard assembly shown in FIG. 3.

FIG. 10 is a schematic cross sectional view providing an enlarged view of the periphery of the fan guard assembly 21 shown in FIG. 3. The reference symbols L1 to L6 in the figure indicate rectilinear lines connecting the center points $C_{40}$ to $C_{45}$ with a point P3 on the edge V (dotted line in the figure) on the discharge port 17*f*, between the upper end and the lower end of the discharge port 17*f*. Note that the point P3 may be any arbitrary point on the edge V. In FIG. 10, the protruding portions 50 to 55 are formed so as to intersect the rectilinear lines L1 to L6, respectively, as is the case of FIG. 8 and FIG. 9. This restricts the movements of the transversal crosspieces 40 to 45 in the directions of the rectilinear lines L1 to L6, and keeps the transversal crosspieces 40 to 45 from moving towards the discharge port 17*f*.

Figure 11:
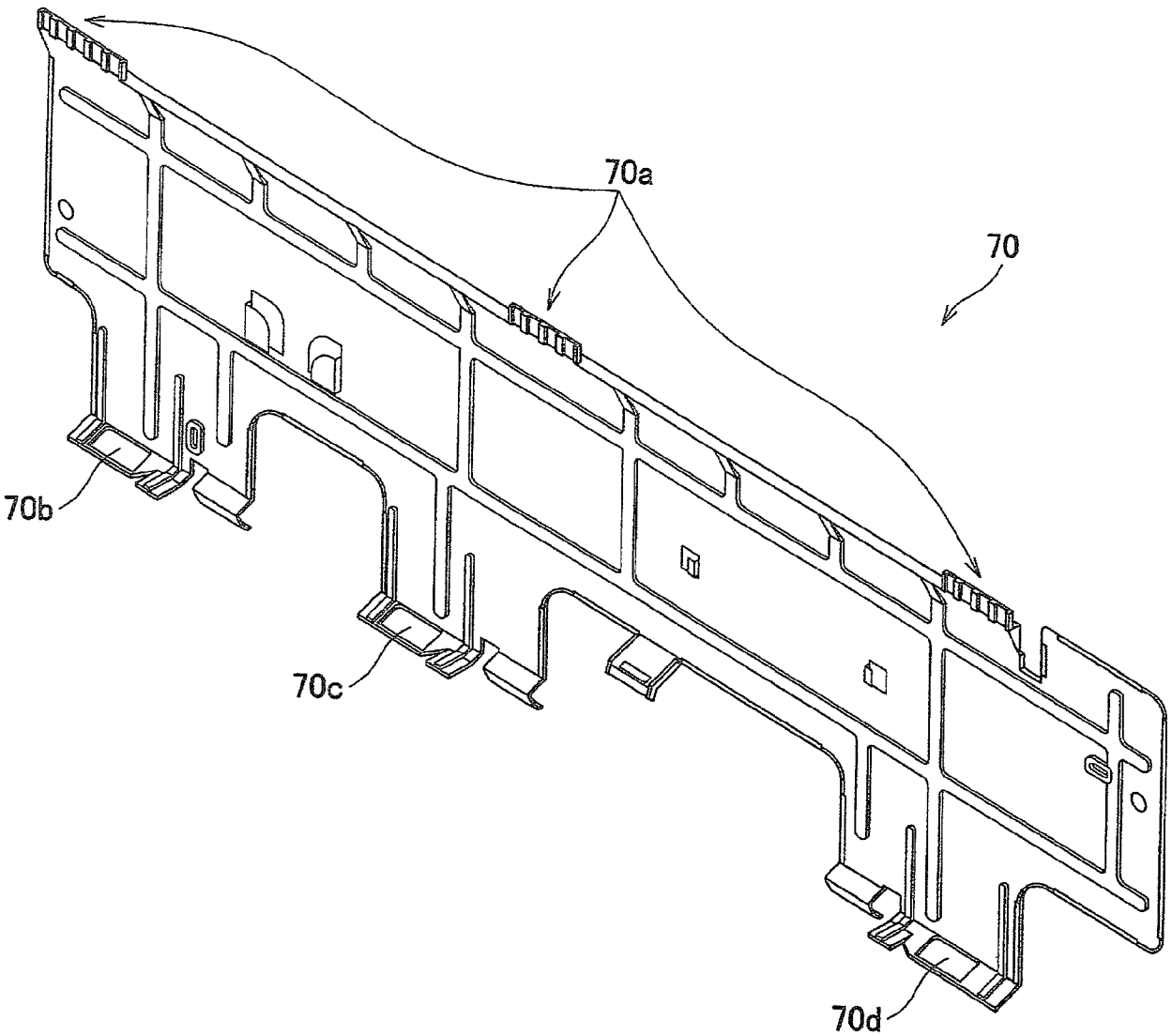
FIG. 11 is a perspective view providing an obliquely front view of amounting board for fixing the indoor unit on a wall.

FIG. 11 is a perspective view providing an obliquely front view of a mounting board 70 for fixing the indoor unit 1 on a wall. As shown in the figure, the mounting board 70 has at its upper part protrusions 70*a* for hooking the upper back face of the front grill 17 when the indoor unit 1 is fixed to the mounting board 70. These protrusions 70*a* are provided at three positions along the length of the mounting board 70, respectively. Further, in the lower part of the mounting board 70, latching holes 70*b*, 70*c*, and 70*d* are successively formed along the length of the mounting board 70.

Figure 12:
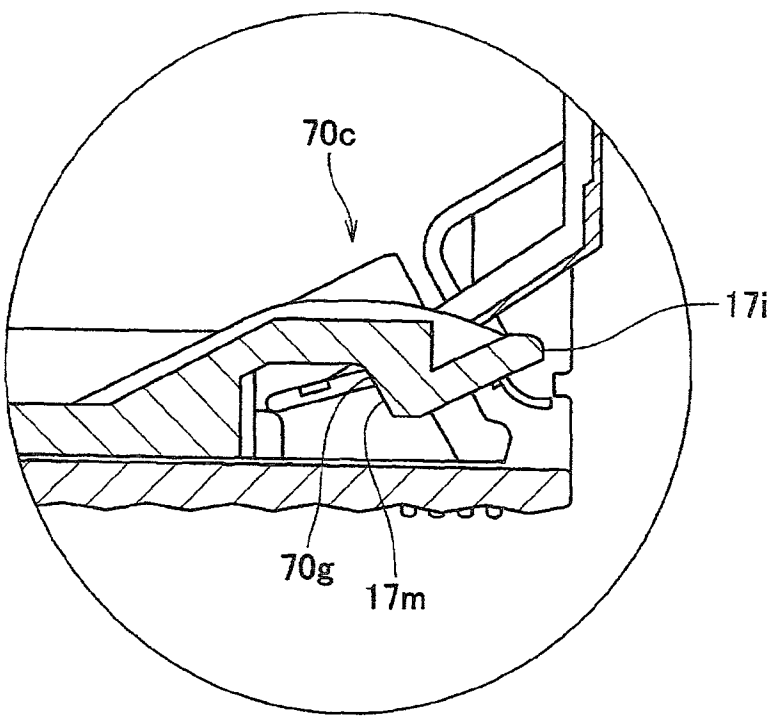
FIG. 12 is a schematic cross sectional view of the indoor unit shown in FIG. 2.
Figure 12:
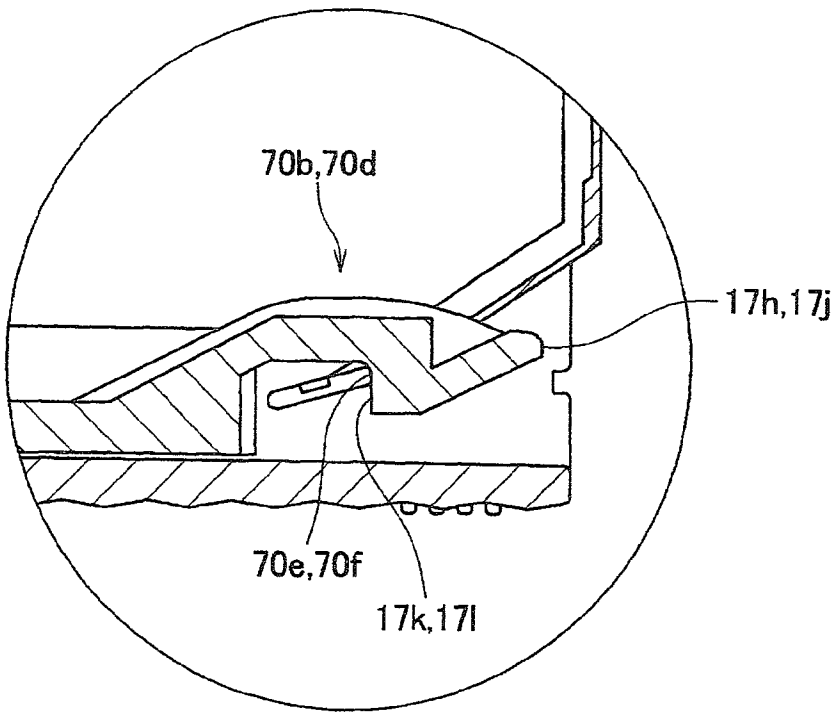

FIG. 12(*a*) is a schematic cross sectional view of the indoor unit 1 taken along the line B-B (D-D) of FIG. 2, and FIG. 12(*b*) is a schematic cross sectional view of the indoor unit 1 taken along the line C-C of FIG. 2. As shown in the figure, the front grill 17 has engaging parts (hook) 17*h*, 17*i*, and 17*j* in positions corresponding to the latching holes 70*b*, 70*c*, and 70*d* of the mounting board 70. The engaging parts 17*h* and 17*j* are provided for the purpose of preventing the main casing 11 from being lifted from the wall surface due to the presence of the conduit 22 (see FIG. 3). Further, the engaging parts 17*h* and 17*j* have vertical faces 17*k* and 17*l*, respectively. As shown in FIG. 12(*a*), these vertical faces 17*k* and 17*l* abut the end portions 70*e* and 70*f* of the latching holes 70*b* and 70*d*, when the indoor unit 1 is fixed to the mounting board 70; i.e., the engaging parts 17*h* and 17*j* are engaged with the latching holes 70*b* and 70*d*, respectively. This abutting restricts the movement of the engaging parts 17*h* and 17*j* towards front (in a direction away from the mounting board 70).

On the other hand, as shown in FIG. 12(*b*), engaging part 17*i* has a slanted surface 17*m* unlike the engaging parts 17*h* and 17*j* formed on the vertical faces 17*k* and 17*l*. This slanted surface 17*m* abuts the end portion 70*g* of the latching hole 70*c*, when the indoor unit 1 is fixed to the mounting board 70; i.e., when the engaging part 17*i* is engaged with the latching hole 70*c*.

Thus, when releasing the indoor unit 1 from the mounting board 70, the engaging parts 17*h*, 17*i*, and 17*j* are respectively disengaged from the latching holes 70*b*, 70*c*, and 70*d* simply by lifting the indoor unit 1 at two positions of the front grill 17 corresponding to the engaging parts 17*h* and 17*j* and pulling the unit to the front (away from the mounting board 70). In other words, the engaged portions are easily disengaged, without a need of lifting the position of the front grill 17 corresponding to the engaging part 17*i*. Thus, one person could easily detach the indoor unit 1.

Further, a traditional small indoor unit has only two engaging parts 17*h* and 17*j* due to its short lengths. Provision of only two engaging parts for a large outdoor unit however may cause deformation of the bottom surface of the outdoor unit and deterioration of the exterior appearance of the outdoor unit, due to the weight of conduit 22 and depending on how the conduit 22 is accommodated. In view of the problem, the engaging part 17*i* is formed in addition to the engaging parts 17*h* and 17*j* in the present embodiment, so as to support the weight of conduit 22 at three positions. This structure prevents deformation of the bottom surface of the outdoor unit, even if the outdoor unit is large.

As described above, the transversal crosspieces 40 to 45 of the present embodiment are held by the retaining grooves 60 to 65, respectively, without a need of penetrating each of the transversal crosspieces through the corresponding one of the longitudinal crosspieces as is the case of the traditional hole penetration type. Therefore, when assembling the fan guard assembly 21, the transversal crosspieces 40 to 45 are easily assembled with the longitudinal crosspieces 30 to 33, respectively.

Further, the transversal crosspieces 40 to 45 are reliably held by disposing the longitudinal crosspieces 30 to 33 apart from one another along the length (direction perpendicular to the sheet surface of FIG. 3) of the discharge port 17*f*, and having these longitudinal crosspieces 30 to 33 hold the transversal crosspieces 40 to 45.

Further, with the provision of the transversal crosspieces 40 to 45 over the entire discharge port 17*f*, it is possible to reliably keep the transversal crosspieces 40 to 45 from being disengaged from the longitudinal crosspieces 30 to 33, when a hand or the like inserted from the outside into the main casing 11 pushes or pulls the transversal crosspieces 40 to 45. Note that, the expression "over the entire discharge port 17*f*" encompasses provision of the transversal crosspieces 40 to 45 over the entire discharge port 17*f* along the length of the discharge port 17*f* (i.e., in the alignment direction of the longitudinal crosspieces 30 to 33), and provision of the transversal crosspieces 40 to 45 over the entire discharge port 17*f* along a direction perpendicular to the length of the discharge port 17*f* (i.e., in the alignment direction of the transversal crosspiece 40 to 45).

Further, the leading ends of the protruding portions 50 to 55 are formed in a substantially triangular shape, instead of a circular shape as is done traditionally. This prevents the wind being disturbed by air vortices generated nearby the leading ends of the protruding portions 50 to 55. Thus, condensation on the fan guard assembly 21 is more effectively restrained in the present invention, as compared with traditional air conditioners.

Further, with the sub-protrusions respectively provided to the protruding portions 50 to 55, the transversal crosspieces 40 to 45 are fixed within the retaining grooves 60 to 65, respectively. Therefore, after the transversal crosspieces 40 to 45 are assembled with the longitudinal crosspieces 30 to 33, the transversal crosspieces 40 to 45 are reliably kept from being disengaged from the longitudinal crosspieces 30 to 33.

Thus, one embodiment of the present invention has been described hereinabove. The specific structures however should not be limited to those described in the above embodiment. The scope of the present invention is defined in the claims set forth hereinbelow, and shall encompass various modifications within the scope defined in claims and those which are equivalent to the claims.

Figure 13:
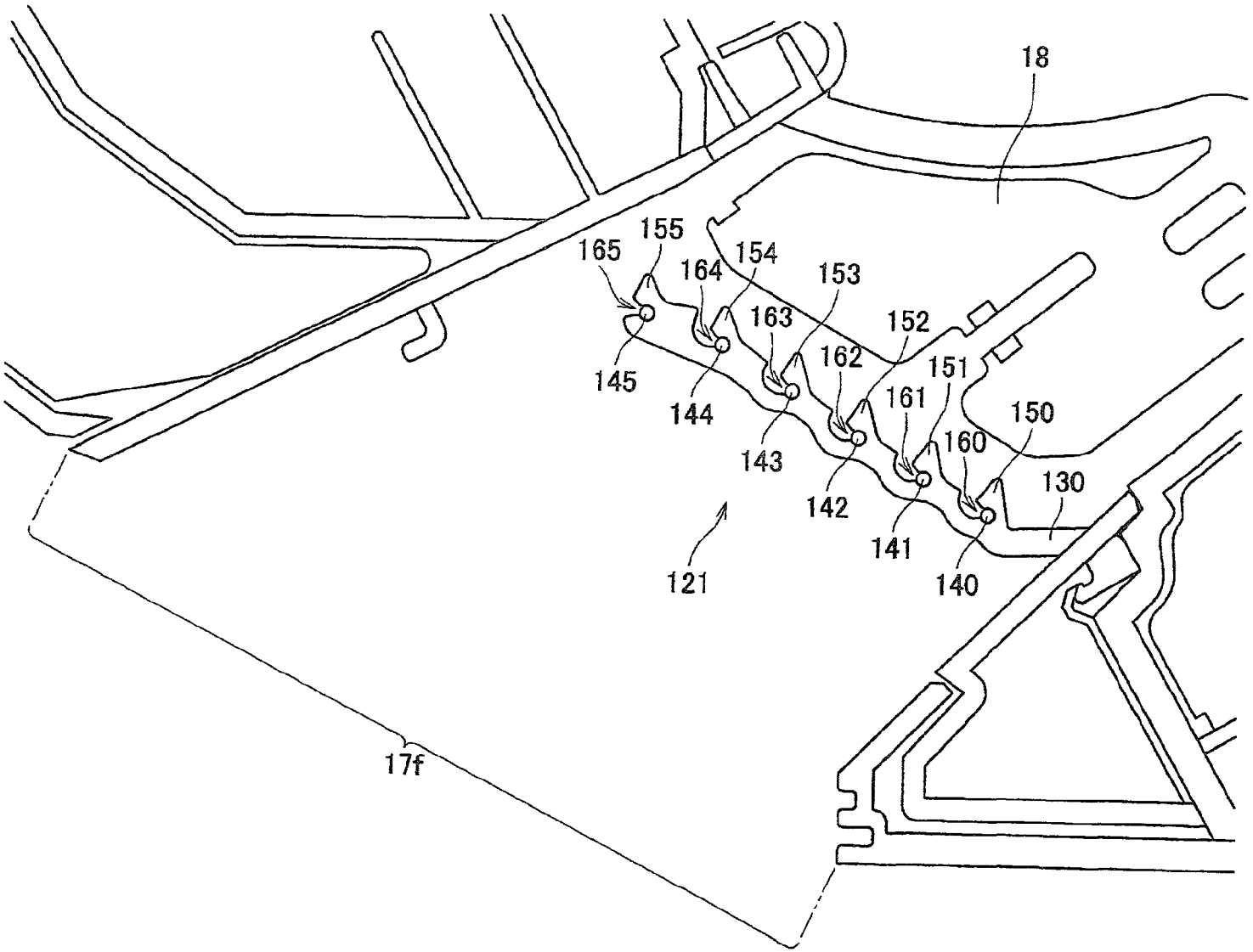
FIG. 13 is a schematic cross sectional view providing an enlarged view of the periphery of the fan guard assembly.
Figure 14:
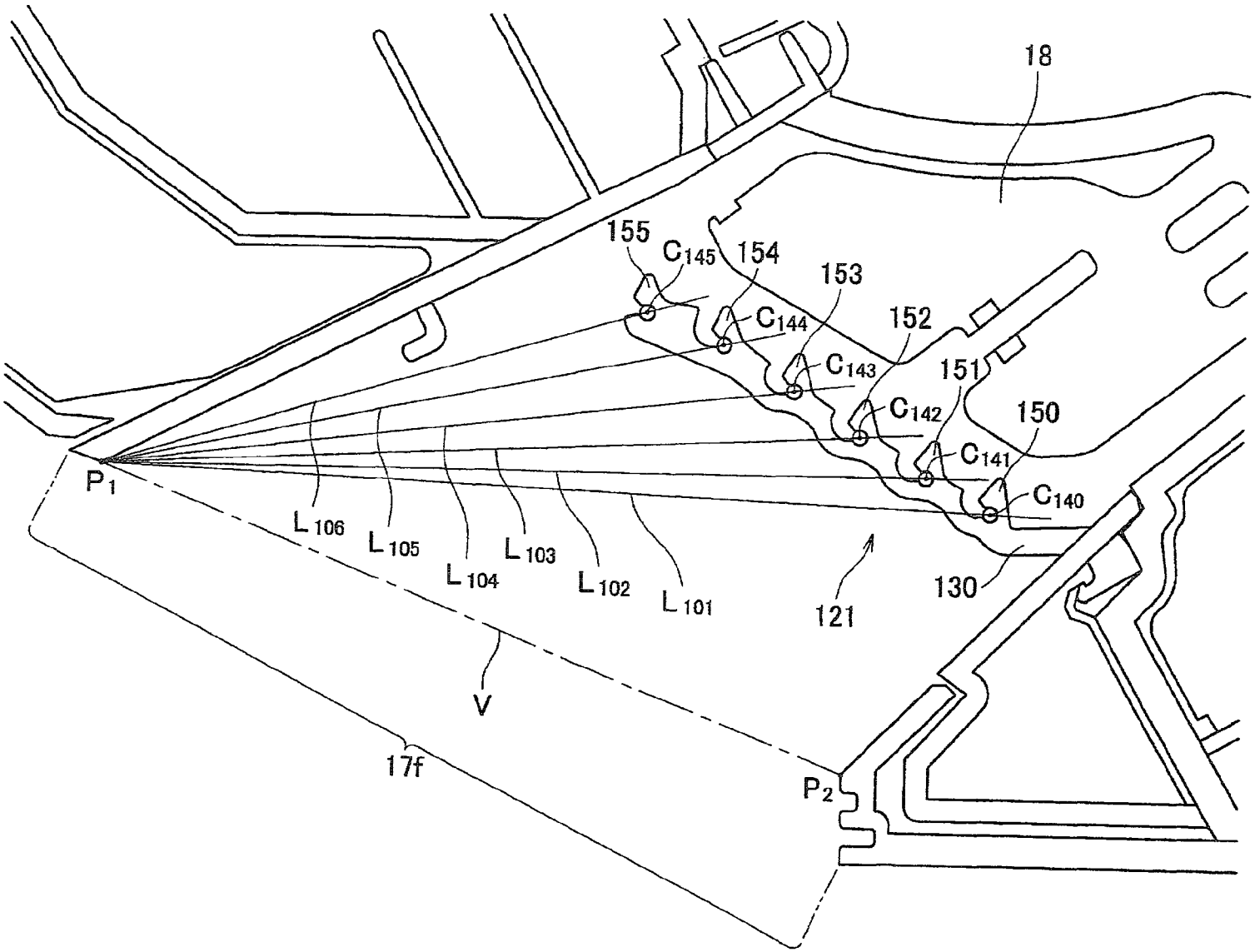
FIG. 14 is a schematic cross sectional view of the fan guard assembly.

The above embodiment deals with an example where the protruding portions 50 to 55 are formed on the side facing the discharge port 17*f*. The present invention however is not limited to the embodiment. For example, as shown in FIG. 13 and FIG. 14, the protruding portions 150 to 155 may be formed on the side closer to the cross flow fan 13. Note that the rectilinear lines L101 to L106 shown in FIG. 14 are rectilinear lines connecting the center points $C_{140}$ to $C_{145}$ of the transversal crosspieces 140 to 145 (second members) held by the longitudinal crosspieces 130 (first members) of the fan guard assembly 121 with the point P1 at the upper end of the discharge port 17*f* of the edge V (dotted line in the figure) of the discharge port 17*f*. As shown in FIG. 14, the protruding portions 150 to 155 are formed so as to intersect the rectilinear lines L101 to L106, respectively. Note that these intersections in FIG. 14 occur outside of the center points $C_{140}$ to $C_{145}$, rather than between the point P1 and the center points $C_{140}$ to $C_{145}$, respectively as is the case of FIG. 8 and FIG. 10.

With this structure, the protruding portions 150 to 155 serves as a barrier that restricts the movement of the transversal crosspieces 140 to 145 along the rectilinear lines L101 to L106. In other words, when the transversal crosspieces 140 to 145 are pushed by a hand or the like inserted from the outside, the transversal crosspieces 140 to 145 are kept from moving towards the cross flow fan 13; i.e., in a direction away from the discharge port 17*f*. Thus, after the transversal crosspieces 140 to 145 are assembled with the longitudinal crosspieces 130, the transversal crosspieces 140 to 145 are reliably kept from being disengaged from the longitudinal crosspieces 130.

INDUSTRIAL APPLICABILITY

With the present invention, there is provided an air conditioner having a fan guard assembly whose transversal crosspieces are hard to disengage from the longitudinal crosspieces.

The invention claimed is:

1. An air conditioner, comprising:

a housing accommodating therein an air delivery fan and having a discharge opening from which an airflow generated by the air delivery fan is blown out; and a fan guard assembly disposed between the air delivery fan and the discharge opening in the housing, wherein the fan guard assembly includes:

first members which are provided at intervals along the length of the discharge opening, the first members including a pair of outer first members and at least two intervening first members that are provided between the pair of outer first members along the length of the discharge opening, and each of the first members having integrally formed protruding portions protruding in such a manner as to form retaining grooves, and second members held in the retaining grooves of the first members;

each of the second members is retained only by a set of retaining grooves comprising one retaining groove of each of the first members such that, along an uninterrupted portion of the length of the discharge opening between the pair of outer first members, each of the second members is retained only by the retaining grooves of the respective intervening first members, which are in the same set of retaining grooves for retaining the same one of the second members, and which are open in the same direction, and the protruding portions protrude in such a manner that, in a side view, each protruding portion intersects each respective rectilinear line that passes a center point of the second member at the corresponding retaining groove and each point along an edge of the discharge opening.

2. The air conditioner according to claim 1, wherein the protruding portions that hold at least one of the second members protrude towards the discharge opening so as to form the retaining grooves which open towards a side of the discharge opening.

3. The air conditioner according to claim 1 or 2, wherein:

the retaining grooves of each first member holds a plurality of the second members, respectively; and the second members are disposed over the entire discharge opening.

4. The air conditioner according to claim 1, wherein each protruding portion has a leading end which is formed in a substantially triangular shape.

5. The air conditioner according to claim 1, wherein each protruding portion has a sub-protrusion for fixing within the corresponding retaining groove the second member which is held in that retaining groove.

6. The air conditioner according claim 2, wherein each protruding portion has a leading end which is formed in a substantially triangular shape.

7. The air conditioner according to claim 3, wherein each protruding portion has a leading end which is formed in a substantially triangular shape.

8. The air conditioner according to claim 2, wherein each protruding portion has a sub-protrusion for fixing within the corresponding retaining groove the second member which is held in that retaining groove.

9. The air conditioner according to claim 3, wherein each protruding portion has a sub-protrusion for fixing within the corresponding retaining groove the second member which is held in that retaining groove.

10. The air conditioner according to claim 4, wherein each protruding portion has a sub-protrusion for fixing within the corresponding retaining groove the second member which is held in that retaining groove.

* * * * *